United States Patent [19]

Taylor

[11] Patent Number: 4,540,371

[45] Date of Patent: Sep. 10, 1985

[54] SKI ROPE HANDLE ASSEMBLY

[76] Inventor: James H. Taylor, 601 Second Ave., Red Springs, N.C. 28377

[21] Appl. No.: 516,523

[22] Filed: Jul. 25, 1983

[51] Int. Cl.[3] ..... B63B 21/56

[52] U.S. Cl. ..... 441/69

[58] Field of Search ..... 16/110 R, 111 R; 441/69

[56] References Cited

U.S. PATENT DOCUMENTS 4,043,290 8/1977 Holland ..... 441/69

*Primary Examiner*—Sherman D. Basinger

*Attorney, Agent, or Firm*—Mills & Coats

[57] ABSTRACT

The present invention relates to a ski rope handle assembly. One species of the present invention entails a ski rope handle assembly that includes a double entry figure eight loop connection formed about each end of a ski rope handle. A second species includes an external rope loop connection that is continuously wound in an arcuate fashion about each end of the ski rope handle after which the open, wound loop is directed such that a forward extending portion of the rope adjacent the loop is threaded through an opening formed within an adjacent finger protector sleeve.

7 Claims, 6 Drawing Figures

SKI ROPE HANDLE ASSEMBLY

FIELD OF INVENTION

The present invention relates to ski rope handles and ski rope handle assemblies, and more particularly to ski rope handles of the molded rubber type.

BACKGROUND OF INVENTION

Molded rubber ski rope handle assemblies are known in the art and are widely used by water ski enthusiasts throughout the United States and the world. These molded rubber ski rope handle assemblies are functional and perform very satisfactorily. There is, however, one major area of concern for the manufacturers of such molded rubber ski rope handle assemblies and ski rope handle assemblies in general. This one area of concern deals with manufacturing itself, and this is because the manufacturer of such ski rope handle assemblies tends to be complicated, troublesome and expensive especially from a tooling, manufacturing and assembling point of view. For example, in cases where it is desired to insert the ski rope through the ski rope handle when connecting the ski rope to the handle, it is necessary to drill an opening through the handle. The drilling operation alone is time consuming and expensive, but the drilled opening generally has to be provided with a grommet to prevent the drill opening from cutting or fraying the rope.

Therefore, there is a need for ski rope handle assembly that is simple to manufacture and assemble. Obviously, the more simpler and easier the ski rope handle assembly is to manufacture, then the less expensive one would expect such ski rope handle to be once it reaches the marketplace.

SUMMARY AND OBJECTS OF THE PRESENT INVENTION

The present invention relates to a ski rope handle assembly design that is intended to produce a very functional and reliable molded rubber ski rope handle assembly but at the same time to do so through a relatively simple manufacturing process. Expressed in another way, the ski rope handle assemblies of the present invention are designed to simplify manufacturing especially with respect to the tooling required and the time required to assemble the ski rope handle assembly after the basic components have been brought together.

In this regard, the present invention discloses a first species that relates to a rubber molded ski rope handle assembly wherein the ski rope handle assembly is characterized by a double entry rope connection formed about each end of the handle. In particular, thiconnection about each end of the ski rope handle. Therefore, it is appreciated that this species presents an appropriate competition design inasmuch as the rope is securely attached to the ski rope handle through this double entry figure eight connection.

In a second species disclosed herein, the ski rope is attached to each end of the handle by simply forming a single, centrally open, loop about the handle. From the loop, the ski rope is extended forwardly through an opening formed within an end finger protector sleeve. It is apparent that by simply coupling the rope to the end of the ski rope handle via a loop that no openings or bores are required to be extended radially through the ski rope handle, and hence manufacturing is greatly simplified.

It is, therefore, an object of the present invention to provide a ski rope handle assembly of a molded rubber type that is simple in design and which will allow the same to be manufactured and assembled relatively easy, but which will retain desirable functional qualities of molded rubber ski rope handle assemblies known.

A further object of the present invention resides in the provision of a competition design ski rope handle assembly that includes a double entry figure eight rope connection about each end of the ski rope handle.

Still a further object of the present invention resides in the provision of a ski rope handle assembly and the character referred to above which includes a double entry figure eight connection about each end thereof wherein the ski rope handle assembly is easy and simple to manufacture and assemble.

Another object of the present invention resides in the provision of a ski rope handle assembly of the double entry figure eight connection type wherein the ski rope handle assembly is durable, reliable and easy to use.

A further object of the present invention resides in the provision of a ski rope handle assembly wherein the same is provided with a connecting ski rope that is simply looped about each end of the ski rope handle and wherein the ski rope is not extended through any openings within the handle thereby providing a simple design that can be easily manufactured and assembled.

It is also an object of the present invention to provide a ski rope handle assembly of the type including a simple single loop connection at each end of the ski rope handle for effectively securing the ski rope to the handle.

Other objects and advantages of the present invention will become apparent from a study of the following description and the accompanying drawings which are merely illustrative of the present invention.

SKI ROPE HANDLE ASSEMBLY

Figure 1:
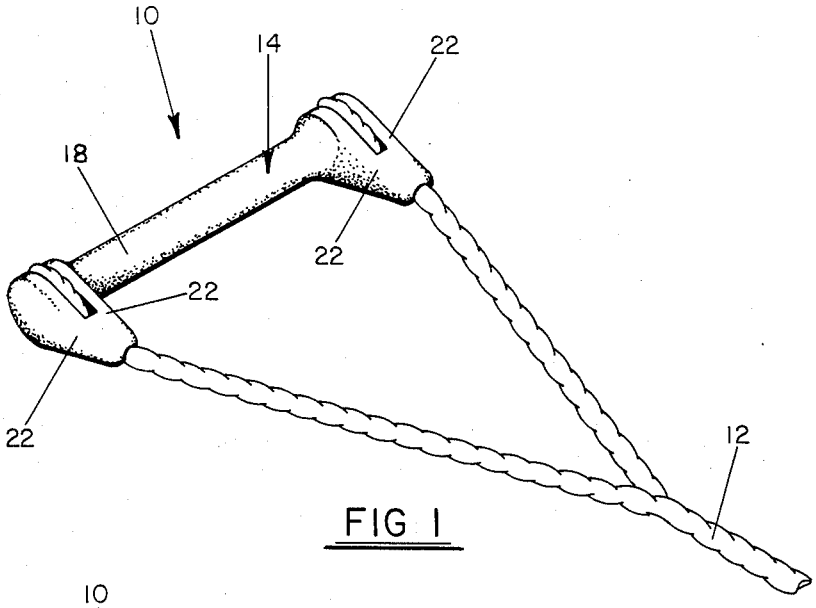
FIG. 1 is a perspective view of a first species of a ski rope handle assembly of the present invention wherein the ski rope is coupled to each end of the ski rope handle through a double entry figure eight connection.
Figure 2:
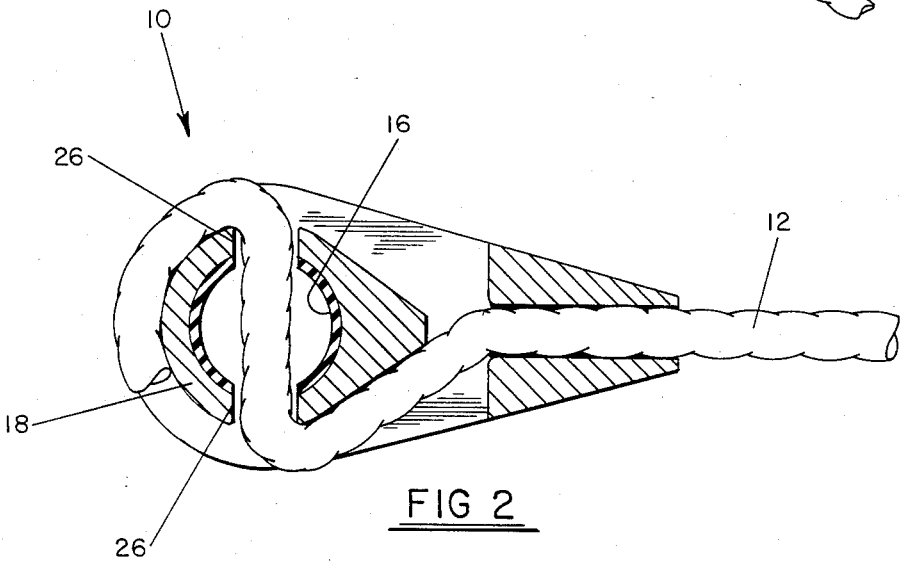
FIG. 2 is a fragmentary side sectional view of an end portion of said ski rope handle assembly shown in FIG. 1 illustrating how the ski rope is threaded through an end portion of said handle to form the double entry figure eight handle rope connection.
Figure 3:
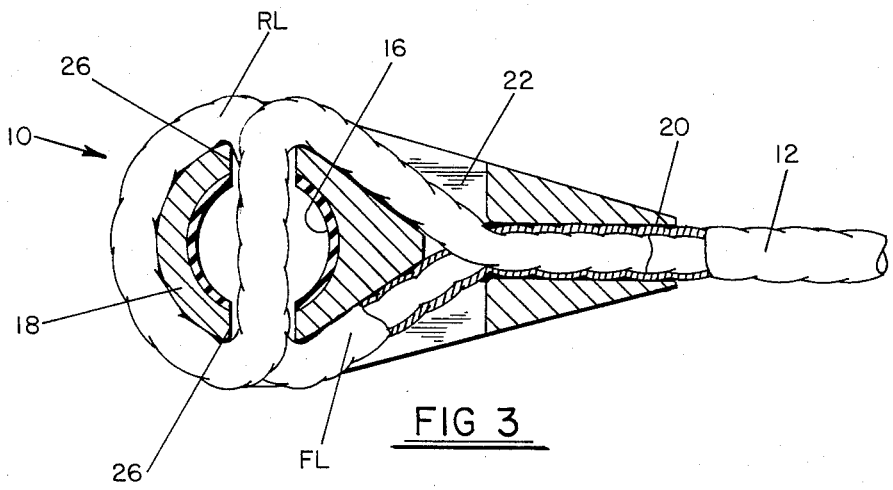
FIG. 3 is a view similar to that of FIG. 2 but with the ski rope being disposed in a completed, secured and coupled figure eight loop connection.

With further reference to the drawings and first with respect to FIGS. 1 through 3, the ski rope handle assembly of the present invention is shown therein in the form of a first species. As will become apparent from subsequent portions of this disclosure, the first species deals with a double entry figure eight loop connection formed about each end of a ski rope handle.

Viewing FIGS. 1 through 3 in more detail, it is seen that the ski rope handle assembly of the present invention is shown therein and indicated generally by the numeral 10. Ski rope handle assembly 10 includes a rope 12 coupled or secured to opposite ends of a ski rope handle, indicated generally by the numeral 14. Ski rope handle 14 includes an elongated core 16, which may preferably be an elongated hollow metal pipe section. It is appreciated that core 16 and the handle would include an elongated axis that would extend axially from one end to the other end of said handle 14.

Formed about core 16 is a rubber molded surface indicated by the numeral 18.

Integrally formed about each end of said handle 14 is a finger protector sleeve that is likewise made of molded rubber. The finger protector sleeve includes a pair of sides 22 that extends in spaced apart relationship forwardly from said handle and wherein the forward portion of said finger protector sleeve includes a generally solid rubber-like tip that includes an elongated rope opening 20 formed therein.

The ski rope handle 14 includes an opening 26 formed about each end thereof in general alignment with opening 20 formed in the finger protector sleeve. Opening 26, however, is oriented such that it extends generally normal or perpendicular with respect to opening 20. As seen in the drawings, opening 26 is oriented such that it extends vertically through the ski rope handle rope assembly 10 as oriented in FIGS. 2 and 3.

As illustrated in FIG. 2, rope 12 is threaded through opening 20 and then through handle opening 26. Once threaded through handle opening 26, the rope is looped around the rear portion of the handle and then threaded back through handle opening 26, hence the "double entry". After being threaded through handle opening 26 for the second time, the rope 20 is then looped around the upper forward portion of the ski rope handle and merged with the ski rope 20 just prior to opening 20 within the finger protector sleeve. Consequently, it is appreciated that rope 20 is secured in a figure eight loop connection about each end of the ski rope handle 14. More particularly, as seen in FIG. 3, the figure eight loop connection includes a pair of side-by-side loops, a rear loop RL and a forward loop FL. Both loops, RL and FL, include an entry rope segment that extend through handle opening 26 in side-by-side relationship. In addition the rear loop RL extends generally around one-half (the rear half as viewed in the drawings) of the rope handle while forward loop FL extends around approximately one-half of the forward portion of the handle 14.

It is appreciated that rope 20 may be threaded to achieve the double entry figure eight connection a number of different ways. In the above discussion, the threading procedure illustrated and discussed was for purposes of explanation.

Figure 4:
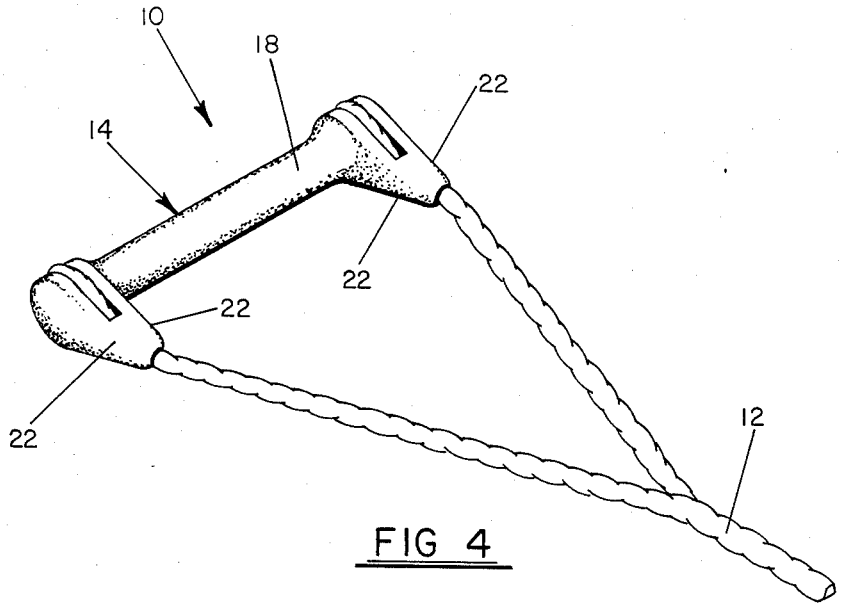
FIG. 4 is a perspective view of a ski rope handle assembly of a second species wherein the ski rope is coupled to each end of the ski rope handle through a single centrally open loop configuration.
Figure 5:
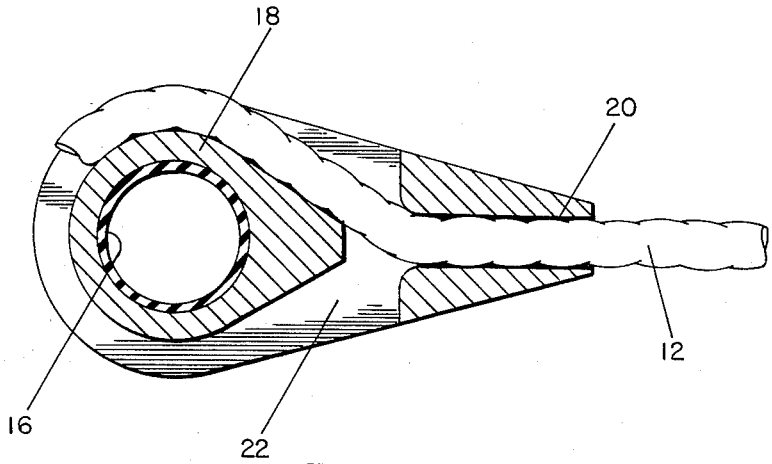
FIG. 5 is a fragmentary side sectional view of an end portion of said ski rope handle assembly shown in FIG. 4 illustrating the ski rope being threaded around the end portion of said ski rope handle.
Figure 6:
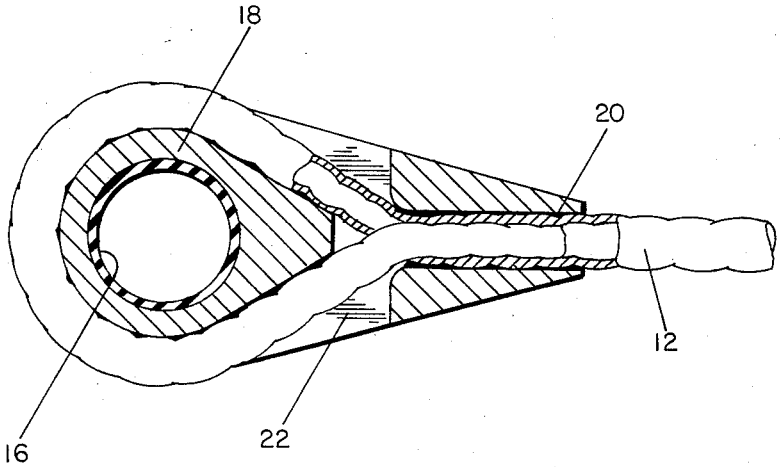
FIG. 6 is a fragmentary side sectional view of the ski rope handle assembly shown in FIG. 4 with the ski rope shown in a completed coupled loop.

Turning to FIGS. 4, 5, and 6, the ski rope handle assembly 10 of the present invention is shown therein in the form of a second species. In this species, the ski rope 20 is threaded around each end of the handle 14 so as to form an open single closed loop connection. By referring to the same as being open, it is meant that the loop does not enter or extend through any transverse portion of the handle 14. Consequently, the loop is open internally. By being closed, it is meant that the loop extends fully around the handle.

As illustrated in FIGS. 5 and 6, rope 12 is threaded through opening 20 and is then directed around each end of the handle 14 so as to form the closed, centrally open loop as illustrated in FIG. 6. Of principal importance in this design is the fact that the loop is not inserted transversely through the handle 14 but simply extends around the handle.

Also in viewing FIG. 6, it is seen that the internally open but generally arcuately closed loop in circling handle 14 is provided with an end rope segment that is merged with an intermediate portion of said rope 12 just prior to the combined ropes being extended forwardly through opening 20 formed in the finger protector sleeve.

From the foregoing specification, it is appreciated that the present invention presents a new and useful ski rope handle assembly that is especially designed to make the manufacturing and assembling of the same relatively easy and convenient. In addition, the present invention presents two ski rope handle assembly designs that are very functional for both competitive and general recreational use, but which are also easy to manufacture and assemble.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A ski rope handle and rope assembly wherein the ski rope is coupled to each end of said handle through a double entry figure eight loop configuration, said ski rope handle and rope assembly comprising: an elongated ski rope handle having an elongated axis and a molded rubber-like surface; a finger protector sleeve formed about each end of said ski rope handle and extending therefrom and including a rope opening that extends therethrough at an angle normal to the elongated axis of said ski rope handle and a transverse opening extending therethrough adjacent to said rope handle and perpendicular to said rope opening wherein said rope opening extends into and terminates at said transverse opening; an opening formed through each end of said handle at an angle perpendicular to the rope opening formed in said finger protector sleeve and generally parallel with said transverse opening of said finger protector sleeve; a pair of rope segments that extend to and couple with opposite ends of said handle through a figure eight rope connection, each of said figure eight rope connections including a double rope entry through said opening formed within said handle so as to form side-by-side rope loops with one rope loop extending around a rear portion of said handle while the other rope loop extends around the forward portion of said handle and wherein said loops include a pair of rope segments that extends in side-by-side relationship through said opening within said handle; and wherein each said rope segment includes an end portion and an adjacent intermediate portion, said end portion being merged with said intermediate portion within said transverse opening prior to extending forwardly into said rope opening.

2. The ski rope handle and rope assembly of claim 1 wherein said rear and forward side-by-side loops formed by each figure eight connection are closed inasmuch as each loop surrounds a half portion of said ski rope handle.

3. The ski rope handle and rope assembly of claim 2 wherein said ski rope handle is of an integral construction inasmuch as said finger protector sleeves are integrally molded with said elongated handle.

4. The ski rope handle and rope assembly of claim 1 wherein a rope channel is defined within each said finger protector sleeve and extends around said rope handle for holding said rope segment as it is looped around said forward and rear portion of said rope handle.

5. A ski rope handle and coupled rope assembly wherein said rope is externally coupled only to said handle at each end by a single rope loop, said ski rope handle and coupled rope assembly comprising: an elongated ski rope handle having an elongated axis and a molded rubber-like surface; a finger protector sleeve integrally formed about each end of said ski rope handle and including a rope opening that extends generally normal relative to the elongated axis of said ski rope handle and a transverse opening that extends through said finger protector sleeve adjacent to said rope handle and perpendicular to said rope opening wherein said rope opening extends into and terminates at said transverse opening, said molded rubber-like surface of said ski rope handle extending generally continuously around said handle so as to enclose the same and including a wedge-like portion that projects from said handle and terminates adjacent said transverse opening; a pair of rope segments that extend to and couple with opposite ends of said handle through respective external only rope loop connections, each external only loop connection including a single non-entry rope loop wound around said handle in a generally continuous arcuate fashion to form a closed loop tie, that is centrally open, about each end of said ski rope handle; and wherein each said rope segment includes an end portion and an adjacent intermediate portion, said end portion being merged with said intermediate portion within said transverse opening prior to extending forwardly into said rope opening.

6. The ski rope handle and rope assembly of claim 5 wherein a rope channel is defined within each said finger protector sleeve and extends around said rope handle for holding said rope segment as it is looped around said forward and rear portion of said rope handle.

7. A ski rope handle and rope assembly wherein the ski rope is coupled to each end of said handle through a double entry figure eight loop configuration, said ski rope handle and rope assembly comprising: an elongated ski rope handle having an elongated axis and a molded rubber-like surface; a finger protector sleeve formed about each end of said ski rope handle and extending therefrom and including a rope opening that extends therethrough at an angle normal to the elongated axis of said ski rope handle and a transverse opening that extends through said finger protector sleeve adjacent to said rope handle and perpendicular to said rope opening wherein said rope opening extends into and terminates at said transverse opening; an opening formed through each end of said handle at an angle generally perpendicular to the rope opening formed in said finger protector sleeve and generally parallel to said transverse opening of said finger protector sleeve; and a pair of ski rope segments that extend to and coupled with each end of said handle through a multi-loop rope connection, each of said multi-loop rope connections including an internal rope entry segment extending through said handle and an external wound segment extending around only a portion of said handle to form a closed loop which only encircles a portion of the handle, and wherein said ski rope segment includes an end portion and an adjacent intermediate portion, said end portion being merged with said intermediate portion within said transverse opening prior to extending forwardly into said rope opening.

* * * * *